US008939291B2

(12) United States Patent
Pedain et al.

(10) Patent No.: US 8,939,291 B2
(45) Date of Patent: Jan. 27, 2015

(54) FLOTATION REAGENT FOR IRON ORES CONTAINING MAGNETITE AND/OR HAEMATITE

(75) Inventors: Klaus-Ulrich Pedain, Dietzenbach-Steinberg (DE); Uwe Dahlmann, Mainz (DE)

(73) Assignee: Clariant Finance (BVI) Limited, Tortola (VG)

( * ) Notice: Subject to any disclaimer, the term of this patent is extended or adjusted under 35 U.S.C. 154(b) by 271 days.

(21) Appl. No.: 13/521,546

(22) PCT Filed: Jan. 4, 2011

(86) PCT No.: PCT/EP2011/000007

§ 371 (c)(1), (2), (4) Date: Jul. 11, 2012

(87) PCT Pub. No.: WO2011/088963

PCT Pub. Date: Jul. 28, 2011

(65) Prior Publication Data

US 2012/0325725 A1 Dec. 27, 2012

(30) Foreign Application Priority Data

Jan. 19, 2010 (DE) ..... 10 2010 004 893

(51) Int. Cl.
*B03D 1/02* (2006.01)
*B03D 1/01* (2006.01)
*B03D 1/004* (2006.01)

(52) U.S. Cl.
CPC ..... *B03D 1/01* (2013.01); *B03D 2203/04* (2013.01); *B03D 1/0043* (2013.01); *B03D 1/02* (2013.01)
USPC ..... 209/166

(58) Field of Classification Search
CPC ..... B03D 1/02; B03D 1/0043; B03D 1/01; B03D 2203/04
USPC ..... 209/166
See application file for complete search history.

(56) References Cited

U.S. PATENT DOCUMENTS 2,389,763 A 11/1945 Cahn
3,363,758 A * 1/1968 Cronberg et al. ..... 209/166
4,319,987 A 3/1982 Shaw et al.
5,540,336 A * 7/1996 Schreck et al. ..... 209/166
6,076,682 A * 6/2000 Gustafsson et al. ..... 209/166
8,205,753 B2 * 6/2012 Pedain et al. ..... 209/166

FOREIGN PATENT DOCUMENTS

DE 4133063 A1 4/1993
DE 102006010939 A1 9/2007
WO WO 97/26995 A1 * 7/1997
WO 00/62937 A1 10/2000
WO 2008/152029 A1 12/2008

OTHER PUBLICATIONS

International Search Report for PCT/EP2011/000007, dated May 10, 2011.
Translation of International Preliminary Report on Patentability for PCT/EP2011/000007, dated May 10, 2011.

* cited by examiner

*Primary Examiner* — Thomas M Lithgow
(74) *Attorney, Agent, or Firm* — Tod A. Waldrop

(57) ABSTRACT

The present invention relates to a flotation reagent for iron ores containing magnetite and/or haematite and to the use of a composition containing A) at least one amine alkoxylate ester of formula (I) or a salt thereof, (1)

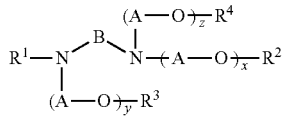

wherein A and B, independently of one another, represent a $C_2$-$C_5$ alkylene radical, $R^1$ is a $C_8$ to $C_{24}$ alkyl or alkenyl radical, $R^2$, $R^3$ and $R^4$, independently of one another, are H or a $C_8$ to $C_{24}$ acyl radical, with the proviso that at least one of the radicals $R^2$, $R^3$ or $R^4$ stands for a $C_8$ to $C_{24}$ acyl radical, x, y and z, independently of one other, are an integer of from 0 to 50, with the proviso that x+y+z is an integer of from 1 to 100, and B) a compound of formula D-$NH_2$, in which D stands for a hydrocarbon radical having from 1 to 50 carbon atoms, which can contain either an oxygen atom or an oxygen atom and a nitrogen atom, in amounts of 10 to 5.000 g/tonne as a collector in the reverse flotation of iron ore containing magnetite, haematite or both.

23 Claims, No Drawings

FLOTATION REAGENT FOR IRON ORES CONTAINING MAGNETITE AND/OR HAEMATITE

The present invention relates to the use of collectors in the beneficiation by flotation of iron ore that contains magnetite and/or hematite.

Many naturally occurring ores and minerals contain silicate as an unwanted accompanying mineral. In addition to iron ore, these include calcite, phosphate ore and feldspar. In particular in the case of iron ore, the silicate content reduces the quality of the iron ore and interferes in the production of iron. In order to obtain high-quality iron ore, it is of interest to lower the silicate content of the iron ore to below 2%. Usually, the iron ore is separated from the silicate not only by magnetic separation, but also by reverse flotation. For this purpose, the ground iron ore is combined in a flotation cell with water and flotation reagents, wherein the silicate is discharged together with the froth by the use of a collector, while the iron ore remains behind in what is termed the pulp.

Silicate collectors which are used are, for example, fatty amines, alkyl ether amines and alkyl ether diamines. These are known under the trade name Flotigam®.

Alkyl ether amines and alkyl ether diamines are chiefly used in their partially neutralized forms as partial acetates, as described in U.S. Pat. No. 4,319,987. The reason therefor is the better solubility thereof in the pulp.

U.S. Pat. No. 6,076,682 describes the combined use of alkyl ether monoamine with alkyl ether diamine for silicate flotation from iron ore.

In WO 00/62937, the use of quaternary amines for flotation of iron ore is disclosed.

In WO-93/06935, the synergistic action of ether amines and anionic collectors for iron ore flotation is described.

Silicate flotation, inter alia from iron ore, using alkyloxyalkanamines is described in U.S. Pat. No. 5,540,337.

DE-A-10 2006 010 939 discloses the use of a compound of the formula (I)

$$R^1—O—R^2—NH_{(2-m)}—[(R^3)_n—H]_m \quad (I)$$

where $R^1$ is a hydrocarbon group having 1-40 carbon atoms, $R^2$ is an aliphatic hydrocarbon group having 2-4 carbon atoms, and $R^3$ is an alkoxy group, n is a number between 1 and 50, and m is 1 or 2, as flotation reagent in silicate flotation.

The collectors known in the prior art for iron ore flotation have inadequate selectivity and yield, in particular when iron ores which contain magnetite and/or hematite are to be separated from silicates as accompanying mineral.

It was therefore the object of the present invention to find an improved collector for reverse iron ore flotation which floats silicates more selectively.

The present invention therefore relates to the use of a composition comprising

A) at least one amine alkoxylate ester of the formula (I) or a salt thereof

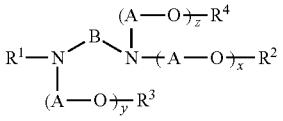

(1)

where

A, B independently of one another are a $C_2$ to $C_5$ alkylene radical $R^1$ is a $C_8$ to $C_{24}$ alkyl or alkenyl radical $R^2$, $R^3$, $R^4$ independently of one another are H or a $C_8$ to $C_{24}$ acyl radical, with the proviso that at least one of the radicals $R^2$, $R^3$ or $R^4$ is a $C_8$ to $C_{24}$ acyl radical x, y, z independently of one another are an integer from 0 to 50, with the proviso that x+y+z is an integer from 1 to 100, and B) a compound of the formula D-$NH_2$, where D is a hydrocarbon radical having 1 to 50 carbon atoms and which can contain either an oxygen atom or an oxygen atom and a nitrogen atom, in amounts of 10 to 5000 g/tonne as collector in the reverse flotation of iron ore which contains magnetite, hematite, or both.

The invention further relates to a method for the reverse flotation of iron ore that comprises magnetite, hematite or both, by contacting the iron ore with a composition comprising A) at least one amine alkoxylate ester of the formula (I) or a salt thereof

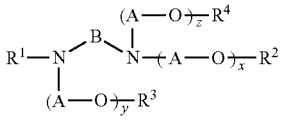

(1)

where

A, B independently of one another are a $C_2$ to $C_5$ alkylene radical $R^1$ is a $C_8$ to $C_{24}$ alkyl or alkenyl radical $R^2$, $R^3$, $R^4$ independently of one another are H or a $C_8$ to $C_{24}$ acyl radical, with the proviso that at least one of the radicals $R^2$, $R^3$ or $R^4$ is a $C_8$ to $C_{24}$ acyl radical x, y, z independently of one another are an integer from 0 to 50, with the proviso that x+y+z is an integer from 1 to 100, and B) a compound of the formula D-$NH_2$, where D is a hydrocarbon radical having 1 to 50 carbon atoms and which can contain either an oxygen atom or an oxygen atom and a nitrogen atom, in amounts of 10 to 5000 g/tonne of iron ore.

The composition of A) and B) is hereinafter also termed "collector according to the invention".

A) and/or B) can be used as described or in the form of salts thereof which are obtainable by reacting A) and/or B) with acids, for example acetic acid or hydrochloric acid.

The ratio of the collector components A:B is preferably between 98:2 and 2:98 by weight, in particular between 70:30 and 30:70 by weight.

In a particularly preferred embodiment, the collector according to the invention is free from quaternary ammonium compounds that comprise at least one organic radical that is bound to the ammonium nitrogen atom, optionally contains heteroatoms, and has 8 to 36 carbon atoms. A quaternary ammonium compound is taken to mean a compound which does not bear a hydrogen atom on the ammonium nitrogen atom, but in which the ammonium nitrogen atom is bound to four carbon atoms. This particularly preferred embodiment is therefore not taken to mean the embodiment in which either the compound of the formula 1 or the compound B) of the formula D-$NH_2$ or both are present as mono- or diammonium salts. These mono- or diammonium salts bear at least one hydrogen atom on the ammonium nitrogen atom.

Component B) can also be used as salt, for example as acetate. Component B) of the collector according to the invention is preferably one or more of the compounds of the formulae (II) to (IV).

These compounds are $$R^9—O—R^5—NH_2 \quad (II)$$

where $R^9$ is a hydrocarbon group having 1-40, preferably 8-32, carbon atoms and $R^5$ is an aliphatic hydrocarbon group having 2-4 carbon atoms;

$$R^6—O—R^7—NH—R^8—NH_2 \quad (III)$$

where $R^6$ is a hydrocarbon group having 1-40, preferably 8-32, carbon atoms, $R^7$ and $R^8$ are an aliphatic hydrocarbon group or different aliphatic hydrocarbon groups having 2-4 carbon atoms;

$$R^{13}—NH_2 \quad (IV)$$

where $R^{13}$ is a hydrocarbon group having 1-40, preferably 8-32, carbon atoms.

$R^1$ is preferably a linear or branched alkyl or alkenyl group which comprises 10 to 22 carbon atoms. Particularly preferably, $R^1$ are isodecyl, isotridecyl, dodecyl, coconut fatty alkyl, or tallow fatty alkyl radicals. $R^1$, in a preferred embodiment, is an alkyl and alkenyl chain section which is derived from coconut oil fatty acid, palm oil fatty acid, tallow fatty acid, oleic acid, tall oil fatty acid or rapeseed oil fatty acid.

$R^2$, $R^3$, $R^4$ independently of one another are acyl radicals having 8 to 24 carbon atoms. The acyl radicals preferably comprise 10 to 18 carbon atoms. They can be linear or branched. The acyl radicals can be saturated or unsaturated. Preferred acyl radicals are stearoyl and oleoyl radicals.

$R^6$, $R^9$, $R^{13}$, independently of one another, are preferably a linear or branched alkyl or alkenyl group which 8 to 18 carbon atoms. Particularly preferably, $R^6$, $R^9$, $R^{13}$ are 2-ethylhexyl, isononyl, isodecyl and isotridecyl and dodecyl radicals.

$R^5$, $R^7$, $R^8$, independently of one another, are preferably alkylene groups having 2, 3 or 4 carbon atoms, in particular ethylene or propylene groups.

A, in particular, is either an ethylene($—C_2H_4—$) group, a propylene($—C_3H_6—$) group or a butylene($—C_4H_8—$) group. Preferably, A is an ethylene group.

B, in particular, is either an ethylene($—C_2H_4—$) group, a propylene($—C_3H_6—$) group or a butylene($—C_4H_8—$) group. Preferably, B is an isopropylene group.

The sum of x, y and z preferably gives an integer from 15 to 30, in particular 20 to 25.

In a preferred embodiment, the amino alkoxylate ester which makes up the component A) is present in the form of the mono- or diammonium salts thereof which are obtained by neutralization either with organic or mineral acids.

The use of the flotation reagent according to the invention can also proceed in combination with frothers and depressants, as are known from the prior art. In order to avoid iron ore being co-discharged in the reverse flotation, preferably hydrophilic polysaccharides, such as, for example, modified starch, carboxymethylcellulose, or gum arabic, are added as depressants in dosages of 10 to 1000 g/t.

Silicate flotation is preferably carried out at a pH of 7-12, in particular 8-11, which is adjusted, for example, using sodium hydroxide.

Examples

The table hereinafter presents the flotation results of the collector according to the invention in comparison with the standard reagent. Flotation experiments were carried out on an iron ore which contained magnetite and hematite.

A) Composition of the Iron Ore

| | |
|---|---|
| Magnetite | 59% by weight |
| Hematite | 25% by weight |
| (other components) | 16% by weight |

B) Composition of the Collectors

Collector 1 (Comparison)

$C_{10}$ alkyloxypropylamine acetate of the formula (II), wherein $R^9$ is a decyl group and $R^5$ is a propyl group.

Collector 2 (Comparison)

Mixture of dicoconut alkyldimethylammonium chloride and ethoxylated coconut alkylpropylenediamine, esterified with oleic acid (corresponding to formula I where A=ethylene, B=propylene, $R^1$=coconut fatty alkyl, $R^2$, $R^3$, $R^4$=oleoyl, the total of x, y, z is 50) in the weight ratio 1:1.

Collector 3 (Comparison)

$C_{10}$ alkyloxydipropylenediamine acetate of the formula (III), wherein $R^6$ is a decyl group, $R^7$ and $R^8$ are a propyl group.

Collector 4 (According to the Invention)

Mixture of 50% by weight of a compound of the formula 1, where

A=ethylene

B=propylene $R^1$=coconut fatty alkyl $R^2$=oleoyl $R^3$=oleoyl and $R^4$=oleoyl the sum of x, y, z is 50, and 50% by weight $C_{10}$ alkyloxypropylamine acetate of the formula (II), wherein $R^9$ is a decyl group and $R^5$ is a propyl group.

Collector 5 (Comparison)

Mixture of 20% by weight dicoconut alkyldimethylammonium chloride, 30% by weight $C_{10}$ alkyoxydipropylenediamine of the formula (III), wherein $R^6$ is a decyl group, $R^7$ and $R^8$ are a propyl group and 50% by weight ethoxylated coconut alkylpropylenediamine, esterified with oleic acid (corresponding to formula I where A=ethylene, B=propylene, $R^1$=coconut fatty alkyl, $R^2$, $R^3$, $R^4$=oleoyl, the sum of x, y, z is 50).

TABLE 1

Effectiveness of the collector according to the invention compared with the prior art

| Example | Collector | Dosage [g/t] | Yield of Fe [%] | Content of Fe [%] |
|---|---|---|---|---|
| 1 (C) | 1 | 70 | 86.5 | 66.8 |
| 2 (C) | 1 | 80 | 84.6 | 67.5 |
| 3 (C) | 1 | 90 | 82.1 | 68 |
| 4 (C) | 2 | 70 | 86.4 | 67.2 |
| 5 (C) | 2 | 80 | 84.3 | 67.8 |
| 6 (C) | 2 | 90 | 81.5 | 68.2 |
| 7 (C) | 3 | 70 | 85.7 | 67.6 |
| 8 (C) | 3 | 80 | 83.9 | 68.2 |
| 9 (C) | 3 | 90 | 82.1 | 68.5 |
| 10 | 4 | 70 | 86.8 | 67.5 |
| 11 | 4 | 80 | 84.9 | 68.3 |
| 12 | 4 | 90 | 81.9 | 68.8 |
| 13 (C) | 5 | 70 | 86.2 | 67.5 |
| 14 (C) | 5 | 80 | 84.6 | 68.1 |
| 15 (C) | 5 | 90 | 82.3 | 68.6 |

Yield of Fe = m(Fe in the concentrate)/m(Fe in the flotation feed) · 100% m(Fe in the concentrate) = content of Fe in the concentrate · m(concentrate)/100% m(Fe in the flotation feed) = content of Fe in the flotation feed · m(flotation feed)/100%

The content of Fe in the concentrate was determined by analysis.

The invention claimed is:

1. A method for the reverse flotation of an iron ore that comprises magnetite, hematite or both, comprising the step of contacting the iron ore with a composition comprising A) at least one amine alkoxylate ester of the formula (I) or a salt thereof

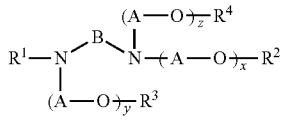

(1)

where

A, B independently of one another are a $C_2$ to $C_5$ alkylene radical $R^1$ is a $C_8$ to $C_{24}$ alkyl or alkenyl radical $R^2$, $R^3$, $R^4$ independently of one another are H or a $C_8$ to $C_{24}$ acyl radical, with the proviso that at least one of the radicals $R^2$, $R^3$ or $R^4$ is a $C_8$ to $C_{24}$ acyl radical x, y, z independently of one another are an integer from 0 to 50, with the proviso that x+y+z is an integer from 1 to 100, and B) a compound of the formula D-$NH_2$, where D is a hydrocarbon radical having 1 to 50 carbon atoms and which can contain either an oxygen atom or an oxygen atom and a nitrogen atom, in amounts of 10 to 5000 g/tonne of the iron ore.

2. The method as claimed in claim 1, wherein $R^1$ is an alkyl or alkenyl radical having 10 to 22 carbon atoms.

3. The method as claimed in claim 1, wherein $R^1$ is an isodecyl, isotridecyl, dodecyl or oleyl radical, or is an alkyl and alkenyl chain section which is derived from coconut oil fatty acid, palm oil fatty acid, tallow fatty acid, tall oil fatty acid or rapeseed oil fatty acid.

4. The method as claimed in claim 1, where $R^2$, $R^3$, $R^4$ independently of one another are acyl radicals having 10 to 18 carbon atoms.

5. The method as claimed in claim 1, where $R^2$, $R^3$, $R^4$ independently of one another are cocoyl, stearoyl and oleoyl radicals.

6. The method as claimed in claim 1, where component B) is selected from the group consisting of compounds of the formulae $$R^9—O—R^5—NH_2 \quad (II)$$

where $R^9$ is a hydrocarbon group having 1-40, carbon atoms and $R^5$ is an aliphatic hydrocarbon group having 2-4 carbon atoms;

$$R^6—O—R^7—NH—R^8—NH_2 \quad (III)$$

where $R^6$ is a hydrocarbon group having 1-40, carbon atoms, $R^7$ and $R^8$ are an aliphatic hydrocarbon group or different aliphatic hydrocarbon groups having 2-4 carbon atoms;

$$R^{13}—NH_2 \quad (IV)$$

where $R^{13}$ is a hydrocarbon group having 1-40, carbon atoms.

7. The method as claimed in claim 6, where $R^6$, $R^9$, $R^{13}$, independently of one another, are an alkyl or alkenyl group having 8 to 18 carbon atoms.

8. The method as claimed in claim 6, where $R^6$, $R^9$, $R^{13}$ are 2-ethylhexyl, isononyl, isodecyl and isotridecyl and dodecyl radicals.

9. The method as claimed in claim 1, where A is an ethylene (—$C_2H_4$—) group, a propylene(—$C_3H_6$—) group or a butylene(—$C_4H_8$—) group.

10. The method as claimed in claim 1, where B is an ethylene(—$C_2H_4$—) group, a propylene(—$C_3H_6$—) group or a butylene(—$C_4H_8$—) group.

11. The method as claimed in claim 1, wherein the sum of x, y and z is an integer from 15 to 30.

12. The method as claimed in claim 1, where the composition is free from quaternary ammonium compounds that comprise at least one organic radical that is bound to the ammonium nitrogen atom, optionally contains heteroatoms, and has 8 to 36 carbon atoms.

13. The method as claimed in claim 1, for the flotation of silicate from iron ore further comprising at least one nitrogenous silicate collector at a pH of 7-12, where the nitrogenous silicate collector is selected from the group of alkyl ether amines, alkyl ether diamines, alkylamines, or quaternary ammonium salts.

14. The method as claimed in claim 1, for enrichment of iron ore.

15. The method as claimed in claim 1, in the flotation of silicate from iron ore, calcite, phosphate ore and feldspar.

16. The method as claimed in claim 1, in the flotation of silicate, wherein the ore comprises between 0 and 90% of silicate.

17. The method of the flotation reagent as claimed in claim 1, further comprising frothers and depressants.

18. The method as claimed in claim 1, in a pH range from 7 to 12.

19. The method as claimed in claim 1, wherein the composition is present in amounts of 0.001 to 1.0 kg per tonne of crude ore.

20. The method as claimed in claim 6, where $R^6$ is a hydrocarbon group having 8-32, carbon atoms.

21. The method as claimed in claim 6, where $R^9$ is a hydrocarbon group having 8-32, carbon atoms.

22. The method as claimed in claim 6, where $R^{13}$ is a hydrocarbon group having 8-32, carbon atoms.

23. The method as claimed in claim 1, where A is an ethylene(—$C_2H_4$—) group.

* * * * *